United States Patent [19]

Drumm

[11] Patent Number: 4,498,210

[45] Date of Patent: Feb. 12, 1985

[54] BRUSH BRISTLE UNIT FOR BRUSH ROLLS

[76] Inventor: Arthur E. Drumm, 20042 State Rte. #4, Marysville, Ohio 43040

[21] Appl. No.: 556,275

[22] Filed: Nov. 30, 1983

[51] Int. Cl.[3] ..... A46B 7/10

[52] U.S. Cl. ..... 15/183

[58] Field of Search ..... 15/179, 181, 182, 183

[56] References Cited

U.S. PATENT DOCUMENTS

| | | | |
|---|---|---|---|
| 2,261,781 | 11/1941 | Smellie | 15/183 |
| 3,065,481 | 11/1962 | Peterson | 15/183 |
| 3,085,274 | 4/1963 | Vincent et al. | 15/183 |
| 3,200,430 | 8/1965 | Haracz | 15/189 |
| 3,225,389 | 12/1965 | Jones | 19/60 |
| 3,533,125 | 10/1970 | Buechel et al. | 15/183 |
| 3,862,463 | 1/1975 | Reiter | 15/182 |

*Primary Examiner*—Peter Feldman

*Attorney, Agent, or Firm*—William V. Miller

[57] ABSTRACT

A bristle section for rotary brushes comprising a bristle-carrying channel fitting into and retained in a mounting channel which has retaining ears along its length which slide into retaining channels in a receiving and retaining channel on the brush drum. The mounting channel is formed with flanges having flared outer edges so as not to tend to cut the bristles as they bend into contact therewith during rotation of the brush.

3 Claims, 5 Drawing Figures

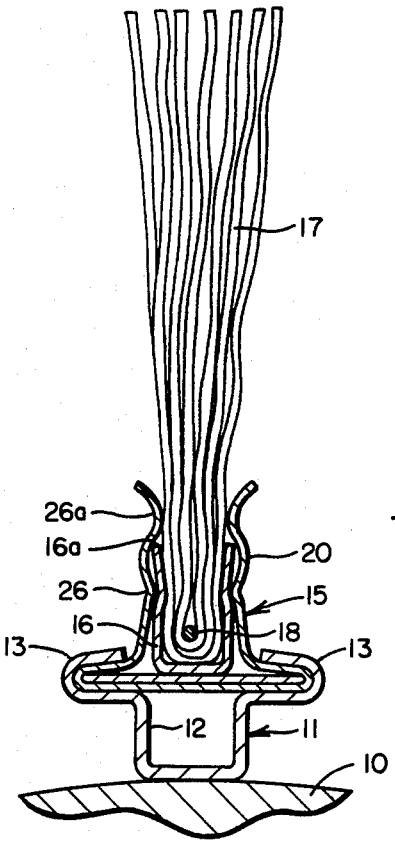
FIG. 3
FIG. 4
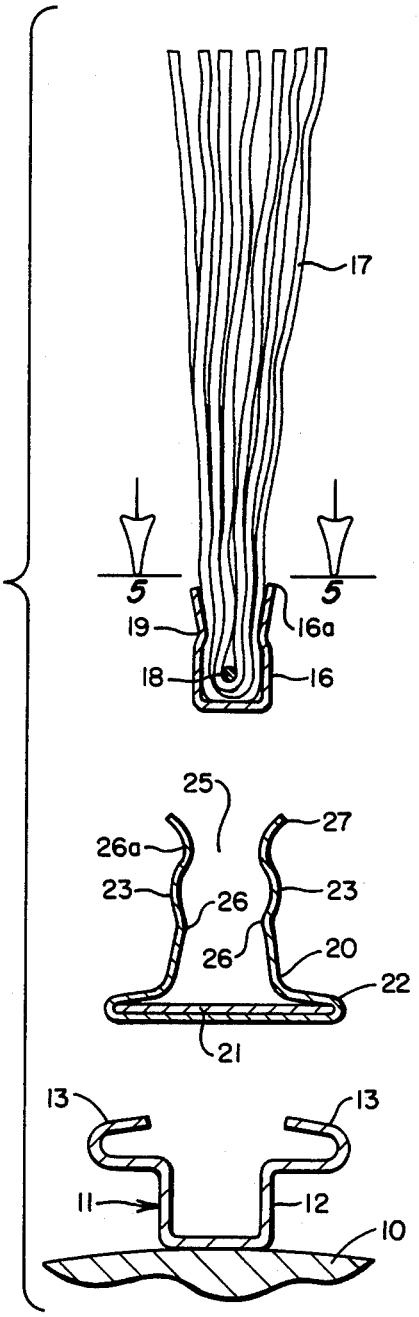
FIG. 5
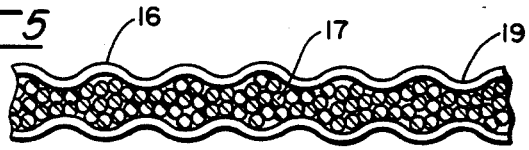

BRUSH BRISTLE UNIT FOR BRUSH ROLLS

BACKGROUND OF THE INVENTION AND PRIOR ART

This invention relates to a brush bristle unit for use mainly as a replacement for present units used on a certain type of rotary brush roll provided on airport runway sweepers. These sweepers have a drum and angularly spaced around the drum are longitudinally-extending receiving and retaining channels which receive and retain the brush units. Each of these prior art brush units consists of fiber bristles mounted by complicated means on a longitudinally-extending retaining strip and extending radially therefrom. There is a need to provide some simple means for replacing these fiber brush bristle units with more durable plastic bristle units and the present invention makes this economically feasible.

SUMMARY OF THE INVENTION

The present invention provides a brush bristle unit which uses an elongated channel assembly in which U-shaped plastic bristles are retained in radially-extending position therein by a retaining wire extending longitudinally through the U of the bristles. The channel assembly is so formed that it will not tend to cut the bristles as they are bent during rotation of the brush roll. Also the channel assembly is so formed that it has guide and retainer portions that can be inserted longitudinally into an end of the usual bristle unit receiving and retaining channel on the drum.

BRIEF DESCRIPTION OF THE DRAWINGS

The best mode contemplated in carrying out this invention is illustrated in the accompanying drawings in which:

FIG. 3 is an enlarged section taken along line 3—3 of FIG. 2;

FIG. 4 is an exploded view of the parts shown in FIG. 3; and

FIG. 5 is a detail in section taken along line 5—5 of FIG. 4.

DETAILED DESCRIPTION OF THE INVENTION

Figure 1:
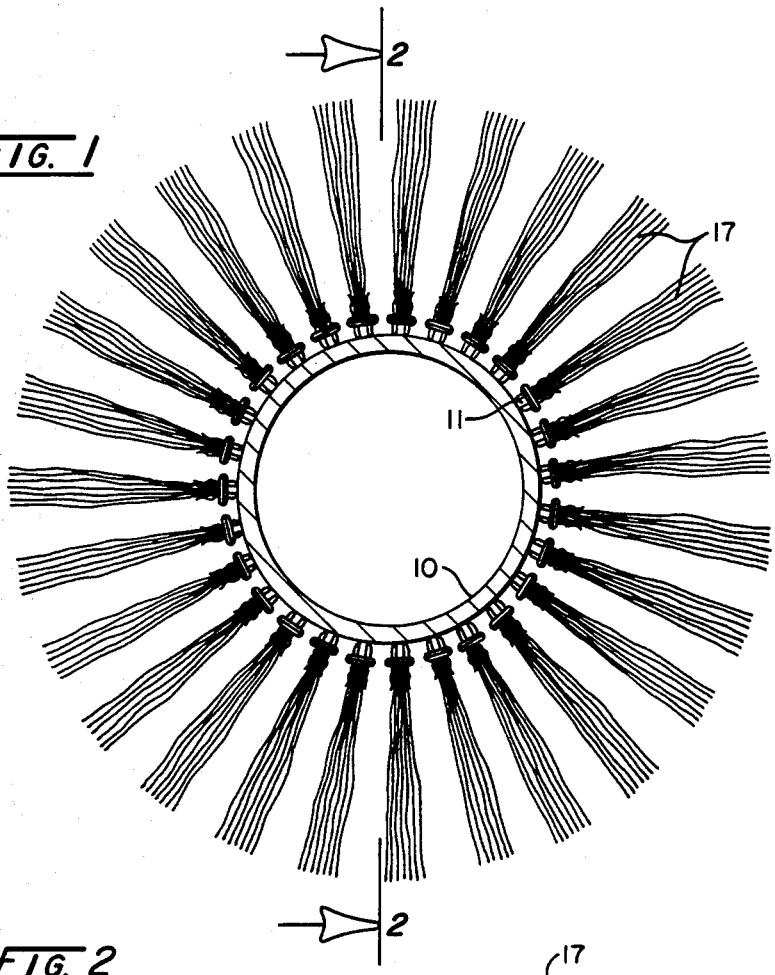
FIG. 1 is a transverse sectional view through a brush roll made up of a number of bristle units of this invention.

With reference to the drawings, there is illustrated the usual drum 10 of a common type of a large sweeper often used in sweeping airport runways. At closely angularly-spaced intervals the drum is provided with longitudinally-extending bristle unit receiving and retaining channels 11 which are suitably secured to the circumference of the drum as by welding. Each channel 11 is of special formation (FIG. 4) having a lower or inner section 12 of U-form and integral opposed upper or outer guiding and retaining channel socket sections 13. The section 12 is provided for receiving part of the bristle-retaining means for the prior art fiber bristle unit but the space provided thereby is not utilized in the present invention.

The bristle unit or assembly of this invention is indicated generally by the numeral 15 and includes a bristle-receiving and carrying elongated channel 16, preferably of metal, into which the U-shaped bristles 17, preferably of plastic, are inserted with their U-ends inwardly in the outwardly-opening channel. To retain the U-bristles in the channel, a retaining wire 18 is passed through the bristles at their closed or U-ends and the flanges of the channel are then crimped at opposed longitudinally-spaced intervals 19 radially-outwardly of the wire.

The bristle unit of this invention further includes a second or mounting channel 20, preferably of metal, which is co-extensive longitudinally with and receives the bristle-carrying channel 16. The base or inner side of this channel is bent around a longitudinally co-extensive flat stiffening bar 21 of metal to form the opposed guide and retaining double-flanged longitudinally continuous ears 22. This formation of the channel also provides the outwardly-extending spring retaining flanges 23 of special formation which provide an outwardly-opening socket 25 between them for receiving the bristle-carrying channel 16. The flanges 23 have opposed-inwardly projecting and longitudinally-extending inner ribs 26 and outer ribs **26*a* spaced radially-outwardly. Ribs 26 will engage the crimped sides of the channel 16 when it is forced longitudinally inwardly into the socket 25 from one end of the channel 20. Ribs 26*a* will extend over the outer edges of flanges 16*a* of channel 16 into contact with fibers 17. The outer edges of the flanges 23 are flared with outward curves 27 to prevent cutting of the bristles 17** as they are bent into contact with these flanges during the sweeping operation.

Figure 2:
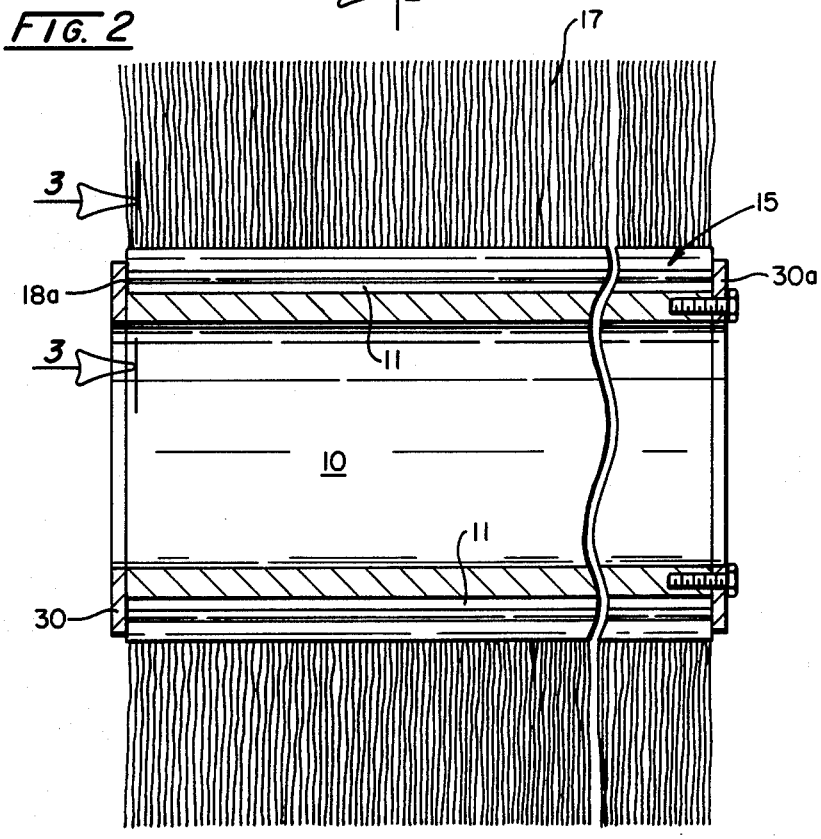
FIG. 2 is a partial axial sectional view of the brush roll of FIG. 1 taken along line 2—2.

In mounting each bristle unit 15 of this invention on the drum 10, it is slipped into an open end of a drum channel 11. The flanged ears 22 are slipped into the guides provided by the channel socket sections 13 (FIG. 3). Thus, when properly positioned in channel 11, the mounting channel 20 cannot move radially relative thereto and the bristle unit 15 of this invention is retained in proper operative radial position on the drum 10. To prevent longitudinal movement on the drum one end of the drum may have a fixed collar 30 mounted thereon (FIG. 2) and the other end a removable collar **30*a* suitably mounted thereon to close the ends of channel sections 13. When the drum rotates and the bristles 17 bend, they will contact the outwardly curved edges 27 of the flanges 23** and will not tend to be cut thereby.

It will be apparent that the above-described invention provides for a simple replacement brush bristle unit for a prior-art type now commonly in use. The unit is simple to mount on the drum or remove for replacement. When on the drum it will be securely held in proper operative position. Also, the bristles are so carried that the mounting means will not tend to cut them during rotation of the brush.

What is claimed is:

1. A bristle unit for slipping longitudinally into a longitudinally-extending channel socket on a sweeper drum, the channel socket having laterally-opposed guiding and retaining channel socket sections opening laterally-inwardly towards each other, comprising a mounting channel of metal having a base formed around a flat longitudinally-extending stiffening bar to form opposed laterally-outwardly extending parallel guiding and retaining double-flanged ears that are longitudinally continuous and adapted to slip longitudinally into said channel socket sections, and laterally-spaced parallel longitudinally extending spring flanges projecting radially-outwardly from said ears to receive a bristle strip therebetween, said bristle strip being formed of a U-shaped longitudinally-extending channel having laterally-spaced side flanges which project radially outwardly in the same direction as said spring flanges and which receive therebetween U-shaped bristles that have their inner U-ends retained therein by a retaining wire extending longitudinally therethrough and crimping at the sides of the flanges radially-outwardly of the wire, said spring flanges having two pairs of longitudinally-extending continuous ribs formed therein and consisting of inner and outer opposed ribs which project laterally-inwardly at radially-spaced inner and outer positions, the inner pair engaging the crimped sides of said flanges of the bristle-carrying channel and the outer pair extending over the outer edges of the flanges thereof, said flanges having laterally-outwardly flared curbed outer edges to prevent cutting of the bristles thereby when the bristles are bent into contact therewith during rotation of the drum.

2. As assembly of a bristle unit according to claim 1 on a sweeper drum having the receiving and retaining channel socket with the laterally-opposed channel socket sections receiving the laterally-opposed guiding and retaining ears on the mounting channel.

3. An assembly according to claim 2 including stop means for longitudinally-retaining the bristle unit in the socket sections of the mounting channel, said stop means engaging the opposed ends of said bristle unit.

* * * * *